United States Patent [19]

Hagerman

[11] 4,054,048

[45] Oct. 18, 1977

[54] ROTARY METAL EXTRUSION APPARATUS

[75] Inventor: Kenneth C. Hagerman, Henrico County, Va.

[73] Assignee: Reynolds Metals Company, Richmond, Va.

[21] Appl. No.: 726,234

[22] Filed: Sept. 24, 1976

[51] Int. Cl.[2] ..... B21C 23/00

[52] U.S. Cl. ..... 72/262

[58] Field of Search ..... 72/262, 273, 263, 270; 425/224, 376

[56] References Cited

U.S. PATENT DOCUMENTS

| | | | |
|---|---|---|---|
| 2,754,544 | 7/1956 | Bicher, Jr. | 425/224 |
| 3,765,216 | 10/1973 | Green | 72/262 |
| 3,872,703 | 3/1975 | Green | 72/262 |
| 3,922,898 | 12/1975 | Voorhes | 72/262 |

*Primary Examiner*—Michael J. Keenan

*Attorney, Agent, or Firm*—Glenn, Lyne, Gibbs & Clark

[57] ABSTRACT

A rotary metal extrusion apparatus comprises a rotatable drum having a circumferential groove around its outer edge. A shoe, fixed relative to the drum, projects into the groove to form an elongated passageway having one end blocked by an abutment mounted in fixed relation to the shoe. The abutment has an extrusion orifice or die therein or adjacent thereto. The extrusion material is fed into the other end of the passageway and is drawn toward the die and abutment by frictional forces of the drum's groove. The pressure on the extrusion material causes its yield point to be exceeded so that the material is extruded through the die orifice. The portion of the shoe which is in sliding contact with the drum comprises a bearing material to allow sliding contact with the drum surface and reduction of flash through the space between the shoe and the drum.

25 Claims, 7 Drawing Figures

FIG. 1
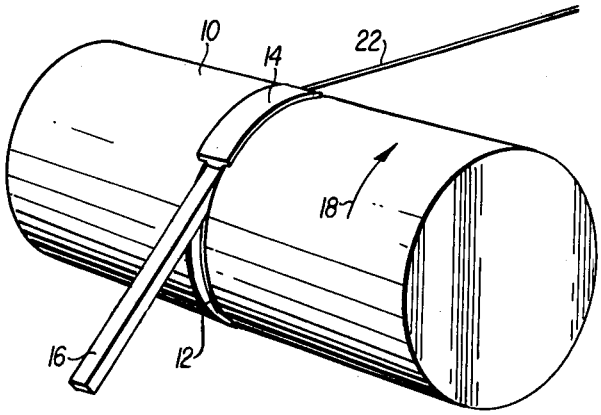
FIG. 2 (PRIOR ART)
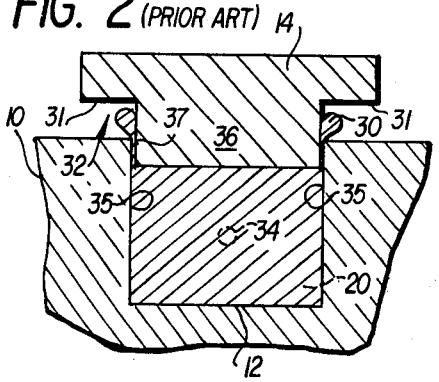
FIG. 3
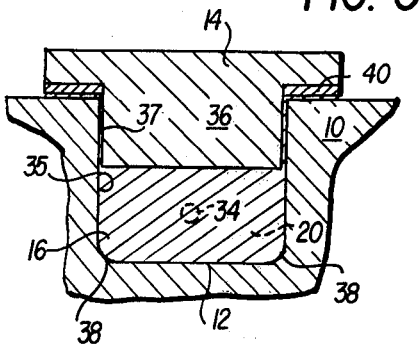
FIG. 4
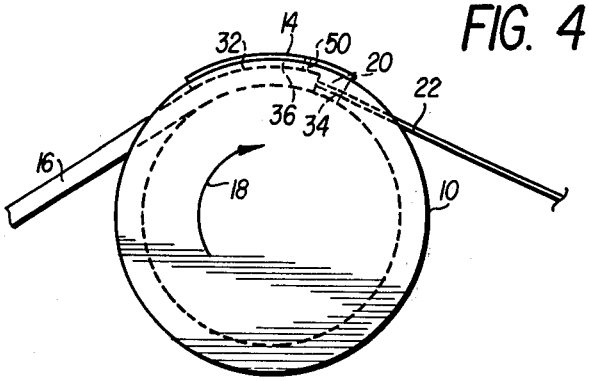
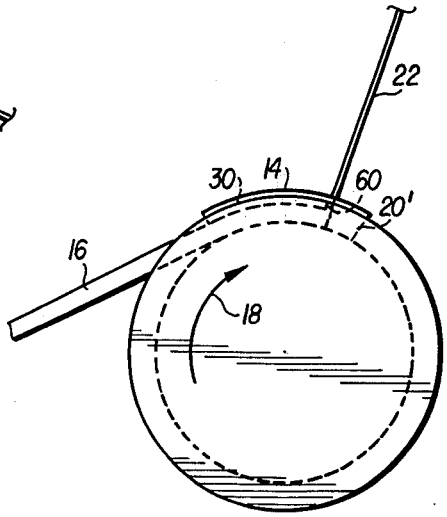
FIG. 5

ROTARY METAL EXTRUSION APPARATUS

BACKGROUND OF THE INVENTION

The present invention relates to the extrusion of metals. In this respect, U.S. Pat. No. 3,872,703 to Green teaches rotary metal extrusion through the use of a shoe and groove apparatus. That is, the surface of a rotatable cylindrical wheel or drum has a groove whose dimensions are approximately the same as the external dimensions of the material to be extruded. Operating in conjunction with this groove is a fixed shoe member positioned above the groove to form an elongated passageway between the shoe and the drum. At one end of the shoe a die-carrying abutment member projects into and closes off the passageway.

As extrusion material is fed into the open end of the elongated passageway, three of its sides are gripped by the groove and the fourth side abuts the shoe. The friction generated by the three sides of the groove is greater than the total friction generated on the single side by the shoe. Hence, the rotation of the drum draws the extrusion material through the passageway to the abutment member, and places the extrusion material under such internal pressure that its yield point is exceeded. In this manner the extrusion material is extruded through the die and drawn off.

Major difficulties experienced in prior devices, however, are binding of the shoe on the drum and the production of excess amounts of flash, flash being extrusion material that passes through clearance spaces between the shoe and the drum. Binding has occured either when too much flash escaped or when attempts were made to reduce clearance spaces between the shoe and the drum.

Attempts have been made to eliminate or reduce flash by extending the shoe member into the passageway a small amount. See, for example, the Green patent mentioned above. While such attempts may keep the amount of flash from increasing if the shoe member moves away from the drum, they still allow flash to pass between the sides of the shoe's inwardly projecting portion and the sides of the groove. This flash is undesirable because, aside from being wasted metal, it can accumulate between the shoe and the drum and cause them to bind. Therefore, it is an object of the present invention to provide an improved continuous rotary metal extrusion apparatus such that excess flash is reduced to an acceptable level and the shoe does not tend to bind on the drum.

SUMMARY

The foregoing and other objects are achieved by projecting a portion of the shoe into the groove and reducing the clearance between the shoe and the external surface of the drum to a substantial "zero clearance", while maintaining a small clearance between the sides of the projecting portion and the sides of the groove. It has been found that the small clearance between the groove and the projection permits enough flash to escape that the extrusion material "lays down" a thin bearing layer on the surface of drum contiguous to the shoe; and this layer not only reduces shoe-to-drum clearance to the desired "substantially zero clearance", but also provides a "self-bearing". Additionally, binding tendencies are further reduced, especially during startup, by the use of a bearing material on the surfaces of the shoe itself. Hence, the combination of these bearing materials allows a high pressure sliding contact, so that the extrusion material is plastically deformed and flows through the abutment die without appreciably flowing or flashing through the substantial zero clearance area between the shoe and the drum.

BRIEF DESCRIPTION OF THE DRAWINGS

Other features and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed on illustrating principles of the invention.

In the drawings:

FIG. 1 is a perspective view of a typical continuous extrusion device;

FIG. 2 is a cross-sectional view of the extrusion portion of the apparatus in FIG. 1 as taught by the prior art;

FIG. 3 is a cross-sectional view of the extrusion portion of the apparatus in FIG. 1 in accordance with the present invention;

FIG. 4 is a side view showing the present extrusion apparatus in operation;

FIG. 5 is a side view of a further embodiment of the present invention;

DETAILED DESCRIPTION OF THE PREFERRED EMBODIMENT

Figure 6:
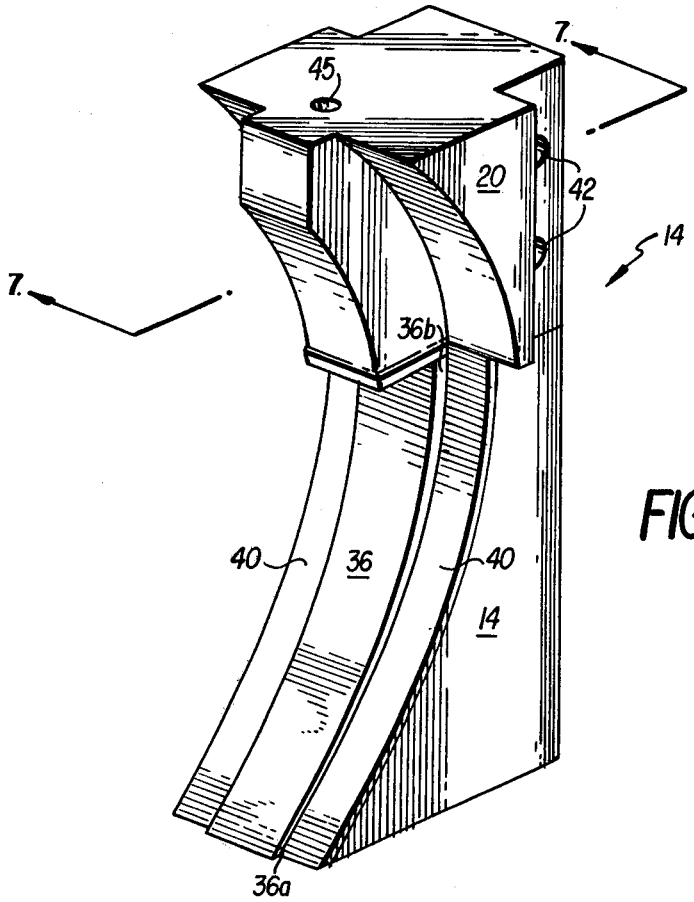
FIG. 6 is a perspective view of a shoe element and an abutment member used in the structure of FIG. 1; and, FIG. 7 is a sectional view of a die portion of the FIG. 6 shoe taken along the lines 7—7 thereof.

A typical extrusion apparatus shown in FIG. 1 comprises a rotating drum 10 containing a groove 12 around its periphery. Closing the upper portion of the groove 12 is a shoe member 14 under which a bar of extrusion material 16 is fed. As the drum rotates in the direction of arrow 18, the extrusion material 16 is frictionally drawn into groove 12 and carried toward an abutment member 20 (FIGS. 2–4). The temperature, caused by frictional heating, and the extremely high pressures caused by the moving extrusion material being blocked by the abutment member 20, cause the extrusion material 16 to be extruded through the abutment member to form extrusion 22. In addition, extrusion power requirements may be reduced somewhat by preheating the extrusion material 16 and/or the drum 10 and show member 14.

FIG. 2 details the formation of flash 30 in the prior art apparatus. In order to prevent binding between the drum 10 and shoulders 31 on the shoe, a clearance 32 has been maintained therebetween. Ideally, the extrusion material 16, due to the temperature and pressures involved, is extruded through die orifice 34 contained in abutment member 20. However, because of the clearance between the sidewalls 35 of groove 12 and an inwardly projecting portion 36 of the shoe, some of the extrusion material flows through the clearance to form flash 30 which accumulates between the shoulders 31 of the shoe 14 and the surface of the drum 10. In this respect, when sufficient flash 30 accumulates in clearance 32, the frictional drag increases between the shoe and the rotating drum so that extrusion is no longer possible.

In FIG. 3 the shoulders 31 of the shoe are inlaid with a bearing material 40, which in one embodiment comprises a silicon-bronze alloy having the following nominal composition Silicon: 3.1%
Zinc: 1.0%
Manganese: 1.1%
Other Materials: 0.5% Maximum
Copper: Remainder.

This bearing material is welded to the shoe member 14 and then machined to the desired size.

The clearance between bearing material 40 and the surface of drum 10 is substantially zero. That is, within reasonable manufacturing tolerances, the radii of the opposing surfaces of the drum 10 and shoulders 31 of the shoe are preferably nominally the same, or perhaps even slightly in interference. The tremendous pressures generated during extrusion, however, tend to force the shoe away from the drum so that a slight clearance exists during operation even though the design clearance is substantially zero.

As noted above, a small amount of extrusion material is permitted to be laid onto the drum below the shoe's shoulders 31. It is in this manner that a "self bearing" layer is formed. This layer preserves bearing material 40 and thereby allows extended use of shoe 14 without replacement of bearing material 40.

When the clearance between the shoulder and the drum is too large, the flash oozes out and causes problems. When the substantially zero-clearance aspects of the invention have been employed, however, a relatively uniform "self bearing" layer has been laid onto the drum to a thickness of about 0.005 inch to 0.030 inch. This layer has both provided a good bearing surface for the shoulders 31 and reduced the amount of flash to minimal amounts. In this respect, it is believed that the bearing material 40 is operative to acceptably reduce otherwise excessive frictional forces during start-up while the self bearing layer starts to build, but the self bearing layer keeps friction acceptably low during continued operation. Without either the layer of bearing material 40 or this self bearing layer of metal, the shoe's shoulders 31 seize on the surface of the drum.

There is a slight clearance between the sides 35 of the groove and the sides 37 of the shoe's inwardly projecting portion 36. This clearance has been as little as 0.002 inch and as much as 0.006 inch on each side of the projecting portion 36, but a preferred clearance range is from 0.003 inch to 0.005 inch; and the preferred design clearance (without allowance for manufacturing tolerances) is 0.004 inch. Side clearances outside of the range between 0.002 inch and 0.006 inch have been found to result in binding of the drum, caused by either mechanical interference or by excessive flash.

It should also be noted that the shoe's inwardly projecting portion 36 extends into groove 12 farther than in prior devices, thus providing a longer path through which the flash must flow before it escapes from the groove 12. This longer flash path in conjunction with the substantially zero clearance between bearing material 40 and drum surface 10 has been found to substantially eliminate the problem of flash accumulation in a rotary extrusion apparatus. In prior devices, on the other hand, flash tended to push the shoe away from the drum thereby increasing the required rotation forces and causing binding.

The depth of the shoe's inwardly projecting portion 36 is at a minimum at 36*a,* where it is farthest from the die, and increases to a maximum at 36*b* at the die. This varying depth allows a gradual feed of the metal stock to be extruded. It is believed that an abrupt change in cross section as the metal enters the passageway would be detrimental to proper metal flow. It has been found that a preferred design depth at 36*b* (without manufacturing tolerances) is about 74.3 times the clearance between the walls 35 of the groove and the sides 37 of the shoe's penetrating portion 36. This ratio is 66.5 at 36*a.* In the above described embodiment, for example, the design depth of the inward projection was 0.297 inch at 36*b* and 0.266 at 36*a,* while the design clearance was 0.004 inch on each side. This depth-to-clearance ratio, however, can be varied over a relatively wide range. In fact, substantially flash-free extrusion may be obtained when the depth-to-clearance ratios at the die are as small as about 50 and as large as about 149.

The sidewalls 35 intersect the bottom of the groove 12 at a radius 38 in order to avoid stress concentrations in the drum. In one instance the radius was omitted, for example, and under the high extrusion pressures the drum cracked at the intersection of the bottom and a sidewall of the groove.

FIG. 6 illustrates a typical shoe 14 and abutment member 20. The shoe 14 is relatively permanently affixed adjacent the drum 10 while the abutment member 20 may be removably affixed thereto by means of a suitable bracket assembly (not shown) secured to holes 42 so that different dies can be placed in the abutment member 20, as will now be described.

Figure 7:
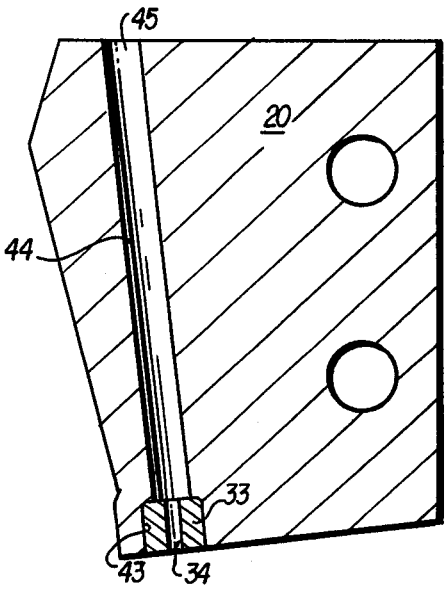

FIG. 7 illustrates a cross section through the abutment member 20. In the abutment member 20, the die 33 with die orifice 34 is inserted in a recess 43. The extruded material 22 (not shown in FIG. 7) leaves die orifice 34 and proceeds through a zone 44 to exit from the abutment 20 through opening 45.

When it is desired to extrude different diameters of wire, rod, bar or shapes, for example, it is merely necessary to insert a different die 33 in the recess 43; and, moreover, if different die sizes are required and cannot be accommodated by the recess 43, it is merely necessary to attach a new abutment member 20 having a recess 43 sized to accommodate differently shaped dies 33. Additionally, as a still further alternative, the abutment member 20 can be made substantially solid without any recess 43 at all and merely have a die opening corresponding to 34 drilled or milled therein.

In operation, as shown in FIG. 4, a bar of extrusion material 16 is fed into the groove 12 as the drum 10 rotates clockwise. It is thereby drawn toward the abutment or dieholder member 20 where the increased pressure causes the extrusion material to exceed its yield point and, with the important exceptions noted above, the inwardly projecting portion 36 of shoe 14 seals the upper portion of the passageway to prevent the meaningful flow of extrusion material except through die orifice 34 to produce the metal extrusion 22.

The bar of extrusion material 16 may be followed by another continuous bar without any other attempt to join them together and without any break in the resulting extruded product. In other words, sequential bars of extrusion material can be self-welded together in the course of being extruded in the apparatus, thereby producing a continuous extrusion.

In a further embodiment (also illustrated in FIG. 4) shoe member 14 has an aperture 50 adjacent abutment member 20 to provide a relief passage in the event the extrusion aperture becomes blocked for some reason. So long as the die remains unblocked, no extrusion material escapes from aperture 50 even though it remains open throughout the process.

In an exemplary apparatus according to the invention, the drum was made of steel and had a diameter of 12.250 inches and a groove of rectangular cross section whose depth was 0.750 inch and whose width was 0.750 inch. The shoe was also made of steel and had a silicon bronze bearing layer 40. The width of the shoe (including the projection and the shoulders) was 2.75 inches). The thickness of the shoulder of the shoe was between 1.000 inch and 3.666 inches. The length of the projection of the shoe, measured along its curved surface, was 6.73 inches. The thickness of the silicon bronze alloy bearing material inlaid on the shoulders of the shoe was nominally 0.005 inch plus normal penetration into the steel of the shoulders. The diameter or the die orifice in a steel abutment menmber was 0.125 inches so that aluminum extruded therethrough was in the form of a continuous ⅛ inch diameter aluminum wire.

In FIG. 5, an abutment member 20' has no extrusion orifice. Instead, an extrusion orifice 60 is provided in shoe member 14 so that the material is extruded in a radial direction. A particular advantage to this radial extrusion embodiment is is that the die-holding portion can be made bigger and stronger so that the extruded product can have a wider range of diameters and shapes.

While the invention has been particularly shown and described with reference to preferred embodiments thereof, it will be understood by those skilled in the art that various alterations in form and detail may be made therein without departing from the spirit and scope of the invention. For example, multiple extrusion dies can be used in conjunction with a single shoe; multiple shoes can be used on a single drum; and the shoe and the abutment can be made in one piece. Also, bearing material 40, instead of being affixed to the shoulder portions of the shoe, can be affixed to the surfaces of the drum upon which the shoulders of the shoe bear, or such bearing material can be affixed to both the shoulder portions of the shoe and such surfaces of the drum.

The embodiments of the invention in which an exclusive property or privilege is claimed is defined as follows:

1. A method of extruding metal by operating rotary metal extrusion apparatus comprising a drum rotatable about an axis and having a curved peripheral surface with a circumferential groove therein, a curved shoe located adjacent said peripheral surface of said drum, said shoe having a projecting portion projecting into said groove to form a passageway with the surfaces of said groove, said shoe also having shoulder portions adjacent said projecting portion, said shoulder portions mating with the peripheral surfaces of said drum adjacent said groove for relative movement with respect thereto, the sides of said projecting portion of said shoe and the sides of said groove having clearance spaces therebetween, an abutment member fixed with respect to said shoe and closing one end of said passageway, and a die located at said closed end of said passageway, said method comprising the steps of:

introducing, into said circumferential groove in said drum, metal to be extruded;

rotating said drum and thereby moving it with respect to said shoe so that frictional drag of the surfaces of said groove draws said metal through said passageway and toward said die;

extruding metal through an orifice in said die to produce an extrusion;

allowing a small quantity of the metal in said groove to flow through said clearance spaces as metal is extruded through said die orifice; and permitting a part of said metal flowed through said clearance spaces to be forced between said shoulder portions of said shoe and said peripheral surfaces of said drum mating therewith, so as to form therebetween a thin bearing layer of the metal;

said bearing layer of the metal to be extruded being in sliding contact with a bearing material different from the materials of said shoe and said drum.

2. The method of claim 1 wherein the thickness of said bearing layer thereof is less than 0.030 inch.

3. The method of claim 1 wherein the thickness of said bearing layer thereof is from about 0.005 inch to about 0.030 inch.

4. The method of claim 3 wherein said drum is comprised of steel and said metal is aluminum.

5. The method of claim 1 wherein said groove has a generally rectangular cross section and said metal to be extruded is in the form of a solid aluminum bar.

6. The method of claim 1 wherein each said clearance space between said projecting portion and a side of said groove is between 0.002 inch and 0.006 inch.

7. The method of claim 6 wherein the ratio of the depth to which said projecting portion projects into said groove to each said clearance space is from about 50 to about 149.

8. A method of extruding metal by operating rotary metal extrusion apparatus comprising a drum rotatable about an axis and having a curved peripheral surface with a circumferential groove therein, a curved shoe located adjacent said peripheral surface of said drum, said shoe having a projecting portion projecting into said groove to form a passageway with the surfaces of said groove, said shoe also having shoulder portions adjacent said projecting portion, said shoulder portions mating with the peripheral surfaces of said drum adjacent said groove for relative movement with respect thereto, the sides of said projecting portion of said shoe and the sides of said groove having clearance spaces therebetween, an abutment member fixed with respect to said shoe and closing one end of said passageway, and a die located at said closed end of said passageway, said method comprising the steps of:

introducing, into said circumferential groove in said drum, metal to be extruded;

rotating said drum and thereby moving it with respect to said shoe so that frictional drag of the surfaces of said groove draws said metal through said passageway and toward said die;

extruding metal through an orifice in said die to produce an extrusion;

allowing a small quantity of the metal in said groove to flow through said clearance spaces as metal is extruded through said die orifice; and permitting a part of said metal flowed through said clearance spaces to be forced between said shoulder portions of said shoe and said peripheral surfaces of said drum mating therewith, so as to form therebetween a thin bearing layer of the metal;

said shoulder portions including a different bearing material that is in contact with said thin bearing layer.

9. The method of claim 8 wherein the metal is aluminum, and the thickness of said bearing layer thereof is from about 0.005 inch to about 0.030 inch.

10. The method of claim 9 wherein said bearing material in said shoulder portions is a silicon bronze alloy.

11. Rotary metal extrusion apparatus comprising:

a drum rotatable about an axis and having a curved peripheral surface with a circumferential groove therein;

a curved shoe located adjacent said peripheral surface of said drum;

said shoe having a projecting portion projecting into said groove to form a passageway with the surfaces of said groove;

said shoe also having shoulder portions adjacent said projecting portion;

said shoulder portions mating with the peripheral surfaces of said drum adjacent said groove for relative movement with respect thereto;

the sides of said projecting portion of said shoe and the sides of said groove having clearance spaces therebetween;

an abutment member fixed with respect to said shoe and closing one end of said passageway;

a die located at said closed end of said passageway;

a bearing material disposed between the shoulder portions of the shoe and said peripheral surfaces of said drum adjacent said groove, said bearing material being different from the materials of said shoe and said drum and different from the metal to be extruded, and means for moving said drum relative to said shoe so that frictional drag of the surfaces of said groove draws metal in said groove toward said die for extrusion through an orifice in said die;

said clearance spaces providing a passage for a small quantity of said metal to flow therethrough so that a portion of said metal passes between said mating surfaces of said drum and said shoulders of said shoe to form a bearing layer thereof in contact with said bearing material.

12. The apparatus of claim 11 wherein said bearing material is a silicon bronze alloy.

13. The apparatus of claim 11 wherein said bearing material is a silicon bronze alloy consisting essentially about 3.1 parts by weight silicon, about 1.1 parts by weight manganese, about 1.0 parts by weight zinc, and from about 94.3 parts to about 94.8 parts by weight copper.

14. Rotary metal extrusion apparatus comprising:

a drum rotatable about an axis and having a curved peripheral surface with a circumferential groove therein;

a curved shoe located adjacent said peripheral surface of said drum;

said shoe having a projecting portion projecting into said groove to form a passageway with the surfaces of said groove;

said shoe also having shoulder portions adjacent said projecting portion;

said shoulder portions mating with the peripheral surfaces of said drum adjacent said groove for relative movement with respect thereto;

said shoulder portions comprising a bearing material that is different from said drum and said shoe;

the sides of said projecting portion of said shoe and the sides of said groove having clearance spaces therebetween;

an abutment member fixed with respect to said shoe and closing one end of said passageway;

a die located at said closed end of said passageway; and means for moving said drum relative to said shoe so that frictional drag of the surfaces of said groove draws metal in said groove toward said die for extrusion through an orifice in said die;

said clearance spaces providing a passage for a small quantity of said metal to flow therethrough so that a portion of said metal passes between said mating surfaces of said drum and said shoulders of said shoe to form a layer of bearing material on at least said drum surfaces.

15. The apparatus of claim 14 wherein said bearing material is a silicon bronze alloy.

16. The apparatus of claim 14 wherein said bearing material is a silicon bronze alloy consisting essentially about 3.1 parts by weight silicon, about 1.1 parts by weight managanese, about 1.0 parts by weight zinc, and from about 94.3 parts to about 94.8 parts by weight copper.

17. The apparatus of claim 11 including an aperture extending from said passageway to a point outside said apparatus to provide for relief of pressure in the event said extrusion die becomes obstructed.

18. The apparatus of claim 11 wherein the drum is substantially cylindrical and said die is located in said abutment member so that the extruded metal leaves said die in a direction substantially tangential to said drum.

19. The apparatus of claim 11 wherein the drum is substantially cylindrical and said die is located so that the extruded metal leaves said die in a direction substantially perpendicular to the direction of travel of the metal as it is moved through said passageway near said die.

20. The apparatus of claim 11 wherein each said clearance space is from about 0.002 inch to about 0.006 inch.

21. The apparatus of claim 20 wherein the ratio of the depth to which said projecting portion projects into said groove to each said clearance space is from about 50 to about 149.

22. Rotary metal extrusion apparatus comprising:

a drum rotatable about an axis and having a curved peripheral surface with a circumferential groove therein;

a curved shoe located adjacent said peripheral surface of said drum;

said shoe having a projecting portion projecting into said groove to form a passageway with the surfaces of said groove;

said shoe also having shoulder portions adjacent said projecting portion;

said shoulder portions mating with the peripheral surfaces of said drum adjacent said groove for relative movement with respect thereto;

the sides of said projecting portion of said shoe and the sides of said groove having clearance spaces therebetween;

an abutment member fixed with respect to said shoe and closing one end of said passageway;

a die located at said closed end of said passageway; and means for moving said drum relative to said shoe so that frictional drag of the surfaces of said groove draws metal in said groove toward said die for extrusion through an orifice in said die;

said clearance spaces providing a passage for a small quantity of said metal to flow therethrough so that a portion of said metal passes between said mating surfaces of said drum and said shoulders of said shoe to form a layer of bearing material on at least said drum surfaces, and the depth of said circumferential groove being uniform about its entire circumference and the depth to which said projecting portion of said shoe projects into said groove decreasing with distance from said die.

23. The apparatus of claim 11 wherein said groove has a generally rectangular cross section.

24. The method of claim 1 wherein said peripheral surfaces of the drum with which said shoulder portions mate include said bearing material.

25. The apparatus of claim 12 wherein said peripheral surfaces of the drum with which said shoulder portions mate comprise said bearing material.

* * * * *